US006360539B1

(12) United States Patent
Hill et al.

(10) Patent No.: US 6,360,539 B1
(45) Date of Patent: Mar. 26, 2002

(54) MICROELECTROMECHANICAL ACTUATORS INCLUDING DRIVEN ARCHED BEAMS FOR MECHANICAL ADVANTAGE

(75) Inventors: Edward A. Hill, Chapel Hill; Vijayakumar R. Dhuler, Raleigh; Allen B. Cowen, Morrisville; Ramaswamy Mahadevan, Chapel Hill; Robert L. Wood, Cary, all of NC (US)

(73) Assignee: JDS Uniphase Corporation, San Jose, CA (US)

( * ) Notice: Subject to any disclaimer, the term of this patent is extended or adjusted under 35 U.S.C. 154(b) by 0 days.

(21) Appl. No.: 09/542,672

(22) Filed: Apr. 5, 2000

(51) Int. Cl.[7] ..... F01B 29/10

(52) U.S. Cl. ..... 60/528; 60/527; 310/306; 310/307

(58) Field of Search ..... 60/527, 528; 310/306, 310/307, 309

(56) References Cited

U.S. PATENT DOCUMENTS 5,867,302 A * 2/1999 Fleming ..... 359/291
5,909,078 A 6/1999 Wood et al. ..... 310/307
5,955,817 A 9/1999 Dhuler et al. ..... 310/307
5,962,949 A 10/1999 Dhuler et al. ..... 310/307
5,994,816 A 11/1999 Dhuler et al. ..... 310/307
6,023,121 A 2/2000 Dhuler et al. ..... 310/307
6,114,794 A * 9/2000 Dhuler et al. ..... 310/307

* cited by examiner

*Primary Examiner*—Hoang Nguyen
(74) *Attorney, Agent, or Firm*—Myers Bigel Sibley & Sajovec

(57) ABSTRACT

Microelectromechanical actuators include a substrate, spaced apart supports on the substrate and a thermal arched beam that extends between the spaced apart supports and that further arches upon heating thereof, for movement along the substrate. One or more driven arched beams are coupled to the thermal arched beam. The end portions of the driven arched beams move relative to one another to change the arching of the driven arched beams in response to the further arching of the thermal arched beam, for movement of the driven arched beams. A driven arched beam also includes an actuated element at an intermediate portion thereof between the end portions, wherein a respective actuated element is mechanically coupled to the associated driven arched beam for movement therewith, and is mechanically decoupled from the remaining driven arched beams for movement independent thereof.

65 Claims, 12 Drawing Sheets

MICROELECTROMECHANICAL ACTUATORS INCLUDING DRIVEN ARCHED BEAMS FOR MECHANICAL ADVANTAGE

FIELD OF THE INVENTION

This invention relates to microelectromechanical systems (MEMS), and more specifically to MEMS actuators.

BACKGROUND OF THE INVENTION

Microelectromechanical systems (MEMS) have been developed as alternatives to conventional electromechanical devices, such as relays, actuators, valves and sensors. MEMS devices are potentially low-cost devices, due to the use of microelectronic fabrication techniques. New functionality also may be provided, because MEMS devices can be much smaller than conventional electromechanical devices.

Many applications of MEMS technology use MEMS actuators. These actuators may use one or more beams that are fixed at one or both ends. These actuators may be actuated electrostatically, magnetically, thermally and/or using other forms of energy.

A major breakthrough in MEMS actuators is described in U.S. Pat. No. 5,909,078 entitled Thermal Arched Beam Microelectromechanical Actuators to the present inventor et al., the disclosure of which is hereby incorporated herein by reference. Disclosed is a family of thermal arched beam microelectromechanical actuators that include an arched beam which extends between spaced apart supports on a microelectronic substrate. The arched beam expands upon application of heat thereto. Means are provided for applying heat to the arched beam to cause further arching of the beam as a result of thermal expansion thereof, to thereby cause displacement of the arched beam.

Unexpectedly, when used as a microelectromechanical actuator, thermal expansion of the arched beam can create relatively large displacement and relatively large forces while consuming reasonable power. A coupler can be used to mechanically couple multiple arched beams. At least one compensating arched beam also can be included which is arched in a second direction opposite to the multiple arched beams and also is mechanically coupled to the coupler. The compensating arched beams can compensate for ambient temperature or other effects to allow for self-compensating actuators and sensors. Thermal arched beams can be used to provide actuators, relays, sensors, microvalves and other MEMS devices. Thermal arched beam microelectromechanical devices and associated fabrication methods also are described in U.S. Pat. No. 5,955,817 to Dhuler et al. entitled Thermal Arched Beam Microelectromechanical Switching Array; U.S. Pat. No. 5,962,949 to Dhuler et al. entitled Microelectromechanical Positioning Apparatus; U.S. Pat. No. 5,994,816 to Dhuler et al. entitled Thermal Arched Beam Microelectromechanical Devices and Associated Fabrication Methods; and U.S. Pat. No. 6,023,121 to Dhuler et al. entitled Thermal Arched Beam Microelectromechanical Structure, the disclosures of all of which are hereby incorporated herein by reference in their entirety.

As MEMS actuators continue to proliferate and to be used in more applications and environments, it would be desirable to allow the displacement and/or force of MEMS actuators to be controlled over wider ranges. Unfortunately, due to the scale of MEMS actuators, only a limited range of displacement and/or force may be obtainable.

A publication entitled Bent-Beam Electro-Thermal Actuators for High Force Applications by Que et al., IEEE MEMS '99 Proceedings, pp. 31–36, describes in-plane microactuators fabricated by standard microsensor materials and processes that can generate forces up to about a milli-newton. They operate by leveraging the deformations produced by localized thermal stresses. It is also shown that cascaded devices can offer a four times improvement in displacement.

Notwithstanding these improvements, there continues to be a need for MEMS actuators that can provide wider ranges of displacement and/or force for various actuator applications.

SUMMARY OF THE INVENTION

Microelectromechanical actuators according to embodiments of the invention include a substrate, spaced apart supports on the substrate and a thermal arched beam that extends between the spaced apart supports and that further arches upon heating thereof, for movement along the substrate. A plurality of driven arched beams are coupled to the thermal arched beam. The end portions of the respective driven arched beams move relative to one another to change the arching of the respective driven arched beams in response to the further arching of the thermal arched beam, for movement of the driven arched beams. A respective driven arched beam also includes a respective actuated element at an intermediate portion thereof between the end portions, wherein a respective actuated element is mechanically coupled to the associated driven arched beam for movement therewith, and is mechanically decoupled from the remaining driven arched beams for movement independent thereof. By allowing independent movement of the actuated elements, a variety of actuator applications may be provided wherein it is desired to actuate multiple elements in the same or different directions.

For example, in first embodiments, the plurality of driven arched beams comprise first and second driven arched beams that extend parallel to one another, such that the actuated elements that are mechanically coupled to the first and second driven arched beams move in a same direction by the further arching of the thermal arched beam. In other embodiments, the first and second arched beams arch away from each other, such that the actuated elements that are coupled to the first and second driven arched beams move in opposite directions by the further arching of the thermal arched beam. In yet other embodiments, the first and second driven arched beams arch toward one another, such that the actuated elements that are mechanically coupled to the first and second driven arched beams move in opposite directions by the further arching of the thermal arched beam.

In other embodiments, the respective end portions are squeezed together by the further arching of the thermal arched beam, to thereby increase arching of the driven arched beam. In alternate embodiments, the end portions are pulled apart by the further arching of the thermal arched beam, to thereby decrease arching of the driven arched beams.

In yet other embodiments, the thermal arched beam includes an intermediate portion between the end portions, and the driven arched beams include intermediate portions between the respective end portions thereof. The intermediate portions of the thermal arched beams are coupled to one of the end portions of the driven arched beams. In first embodiments, the intermediate portion of a second thermal arched beam is coupled to the other of the end portions of the driven arched beams. An H-shaped microelectromechanical actuator thereby is formed, wherein each leg of the H comprises a thermally activated arched beam, and the crossmembers of the H comprises mechanically activated driven arched beams. In second embodiments, an anchor is provided that anchors the other end portions of the driven arched beams to the substrate. Thus, only one end of the driven arched beams is driven by a thermal arched beam actuator. These embodiments thereby form microelectromechanical actuators having a T-shape, wherein the cross-member of the T comprises a thermally activated arched beam and wherein the leg of the T comprises mechanically activated arched beams.

In other embodiments of microelectromechanical actuators according to the present invention, the thermal arched beam extends between the spaced apart supports along a first direction on the substrate, and further arches upon heating thereof, for movement along the substrate in a second direction that is orthogonal to the first direction. The driven arched beams extend along the substrate in the second direction and the arching of the driven arched beams is changed in the first direction by the further arching of the thermal arched beam for movement along a substrate in the first direction.

In yet other embodiments, second spaced apart supports are provided on the substrate, and a second thermal arched beam is provided that extends between the second spaced apart supports and that further arches upon heating thereof for movement along the substrate. The driven arched beams are coupled to the first and second thermal arched beams, such that the arching of the driven arched beams is changed by the further arching of the first and second thermal arched beams. More preferably, the intermediate portion of the first thermal arched beam is coupled to one end portion of the respective driven arched beams, and the intermediate portion of the second thermal arched beam is coupled to the other end portion of the respective driven arched beams.

In still other embodiments, the first and second thermal arched beams extend between the respective first and second spaced apart supports along a first direction on the substrate, and further arch upon application of heat thereto, for movement along the substrate in a second direction that is orthogonal to the first direction. The driven arched beams extend along the substrate in the second direction, and the arching of the driven arched beams are changed in the first direction by the further arching of at least one of the thermal arched beams for movement along a substrate in the first direction. In alternative embodiments, the first and second thermal arched beams extend between the respective first and second spaced apart supports along a first direction on the substrate, and further arch upon application of heat thereto, for movement along the substrate in respective opposite directions that are orthogonal to the first direction. The driven arched beams extend along the substrate along the second opposite directions, and the arching of the driven arched beams are changed in the first direction by the further arching of the thermal arched beams, for movement along the substrate in the first direction.

In other alternative embodiments of the present invention, additional mechanical advantage may be provided by coupling the plurality of driven arched beams to other driven arched beams, to provide cascaded devices. In particular embodiments, a second thermal arched beam is provided on the substrate that extends between second spaced apart supports and that further arches upon heating thereof for movement along the substrate. A first driven arched beam is coupled to the first thermal arched beam, wherein the end portions of the first driven arched beam move relative to one another to change the arching of the first driven arched beam in response to the further arching of the first thermal arched beam, for movement of the first driven arched beam along the substrate. A second driven arched beam is coupled to the second thermal arched beam, wherein the end portions of the second driven arched beam move relative to one another to change the arching of the second driven arched beam in response to the further arching of the second thermal arched beam, for movement of the second driven arched beam along the substrate. The plurality of driven arched beams are coupled to the first and second driven arched beams.

In all of the above-described embodiments, an actuator other than a thermal arched beam actuator also may be used. The actuator includes a driver beam that moves along the substrate upon actuation thereof. Multiple actuators also may be used.

Other embodiments of the present invention use at least one driven arched beam that is coupled to at least one thermal arched and that is arched in a direction that is nonparallel to the substrate. The driven arched beam includes end portions that move relative to one another to change the arching thereof in the direction that is nonparallel to the substrate in response to the further arching of the thermal arched beam, for movement of the driven arched beam toward or away from the substrate. As was described above, the end portions may be squeezed together or pulled apart. In other embodiments, the driven arched beam is arched in a direction that is orthogonal to the substrate, the arching of which is changed in the direction that is orthogonal to the substrate by the further arching of the thermal arched beam for movement orthogonal to the substrate. Out-of-plane actuators thereby may be provided. Other embodiments may provide H-shaped actuators, T-shaped actuators, cascaded actuators and/or multiple driven arched beams that are arched in a direction that is nonparallel to the substrate. In all of these embodiments, actuators other than thermal arched beam actuators that include a driver beam that moves parallel to the substrate upon actuation thereof also may be used.

In yet other embodiments according to the present invention, the intermediate portion of the thermal arched beam is coupled to the intermediate portion of the driven arched beam. First and second fixed supports also may be provided on the substrate, such that the end portions of the driven arched beam are driven against the respective fixed supports and slide along the fixed supports in response to the further arching of the thermal arched beam. Reduced displacement at higher forces may be provided thereby.

In all of the above-described embodiments, reference to a single beam also shall include multiple beams. Moreover, in all of the above-described embodiments, the microelectromechanical actuator may be combined with a relay contact, an optical attenuator, a variable circuit element, a valve, a circuit breaker and/or other elements for actuation thereby. For example, the thermal arched beam may further arch upon heating thereof by ambient heat of an ambient environment in which the microelectromechanical actuator is present, to thereby provide a thermostat. Variable optical attenuator embodiments also may be provided wherein the actuated element selectively attenuates optical radiation between ends of optical fibers that run along the substrate or through the substrate, in response to actuation of one or more thermal arched beams. In all of the above-described embodiments, a trench also may be provided in the substrate beneath at least one of the driven arched beams, to reduce stiction between the at least one driven arched beam and the substrate.

DETAILED DESCRIPTION OF PREFERRED EMBODIMENTS

Figure 1A:
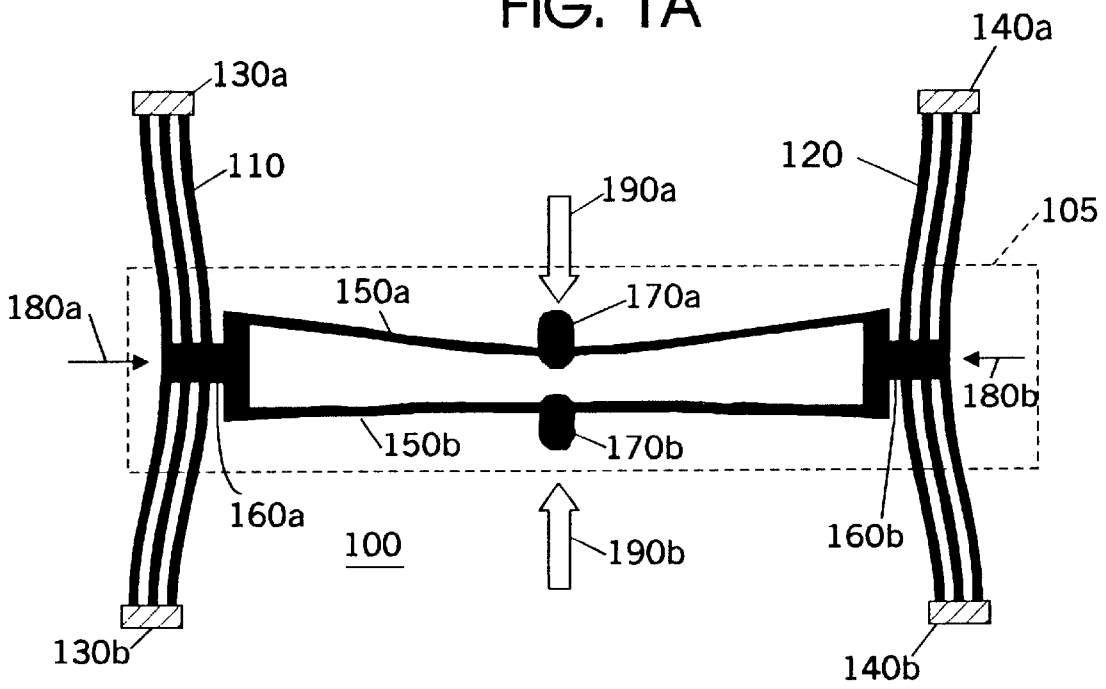
FIGS. 1A–9B and 11A–11B are top views of alternative embodiments of microelectromechanical actuators including driven arched beams for mechanical advantage according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element such as a layer, region or substrate is referred to as being "on", "connected to" or "coupled to" another element, it can be directly on, directly connected to or directly coupled to the other element, or intervening elements also may be present. In contrast, when an element is referred to as being "directly on", "directly connected to" or "directly coupled to" another element, there are no intervening elements present.

Many of the embodiments that are described in detail below, employ thermal arched beam (TAB) actuators. The design and operation of TAB actuators are described in the above-cited U.S. Pat. Nos. 5,909,078, 5,962,949, 5,994,816, 5,995,817 and 6,023,121, the disclosures of all of which are hereby incorporated by reference herein in their entirety, and therefore need not be described in detail herein. However, it will be understood by those having skill in the art that, TABs may be heated by internal and/or external heaters that are coupled to the TAB and/or to the substrate. Moreover, one or more TAB beams may be coupled together and may be supported by one or more pairs of supports. Accordingly, all references to actuation of a TAB actuator shall be construed to cover any thermal actuation technique, all references to thermal arched beams shall be construed as covering one or more thermal arched beams, and all references to a support shall be construed to cover one or more supports that support one or more thermal arched beams.

Finally, in the drawings, fixed supports or anchors are indicated by cross-hatching, whereas movable structures are indicated by solid black. An indication of relative displacement ranges also is provided by using thin arrows for relatively small displacements and thick arrows for relatively large displacements. It also will be understood that these embodiments of microelectromechanical actuators are integrated on an underlying substrate, preferably a microelectronic substrate such as a silicon semiconductor substrate.

Referring now to FIG. 1A, embodiments of microelectromechanical actuators according to the present invention are shown. These microelectromechanical actuators may be referred to as "H-TAB" actuators, due to the H-shaped body thereof and the use of thermal arched beams. As shown in FIG. 1A, the H-shaped body includes a pair of opposing legs, each of which comprises one or more thermal arched beams 110 and 120, and a cross-member comprising a plurality of independently moving mechanically activated arched beams 150*a* and 150*b*.

More specifically, referring to FIG. 1A, these embodiments of microelectromechanical actuators include a substrate 100, a first pair of spaced apart supports 130*a* and 130*b* on the substrate 100, at least one first thermal arched beam 110 that extends between the spaced apart supports 130*a* and 130*b* and that further arches upon application of heat thereto for movement along the substrate in a first direction shown by displacement arrow 180*a*. A second pair of spaced apart supports 140*a* and 140*b* are provided, and at least one second thermal arched beam 120 extends between the second spaced apart supports 140*a* and 140*b*, and further arches in a second direction that is opposite the first direction, shown by displacement arrow 180*b*, upon application of heat thereto for movement along the substrate 100. A plurality of driven arched beams, here two driven arched beams 150*a* and 150*b*, are coupled to the first and second thermal arched beams 110 and 120. In particular, the respective end portions of the driven arched beams 150*a* and 150*b* are coupled to a respective intermediate portion of a respective thermal arched beam 110 and 120, for example using respective couplers 160*a* and 160*b*. A respective driven arched beam 150*a* and 150*b* also includes a respective actuated element 170*a* and 170*b* at an intermediate portion thereof between the end portions. A respective actuated element 170*a* and 170*b* is mechanically coupled to the associated driven arched beam 150*a* and 150*b*, respectively, for movement therewith. A respective actuated element 170*a* and 170*b* is mechanically decoupled from the remaining driven arched beams, for movement independent thereof.

Thus, as shown in FIG. 1A, upon heating of either or both of the thermal arched beam(s) 110 and 120, the end portions of the driven arched beam(s) 150*a* and 150*b* are squeezed together, to thereby increase arching of the driven arched beams. A relatively small amount of displacement in the first or second opposite directions shown by displacement arrows 180*a* and/or 180*b* respectively, can cause a relatively large movement of the actuated elements 170*a* and 170*b* in third opposite directions shown by respective displacement arrows 190*a* and 190*b*, that are orthogonal to the first or second directions shown by displacement arrows 180*a* and 180*b*. A mechanical advantage thereby may be obtained, and a wider range of displacements may be provided.

As also shown in FIG. 1A, a trench 105 optionally may be provided in the substrate 100 beneath at least one of the driven arched beams 150*a* and 150*b*. The trench can reduce stiction between the at least one driven arched beam and the substrate. A trench also may be provided beneath the thermal arched beam(s) 180*a* and/or 180*b* to reduce stiction and/or for thermal isolation. The optional trench 105 also is shown in FIG. 16. Although it also may be included in the other embodiments described below, it is not illustrated to simplify the drawings.

Still referring to FIG. 1A, in the H-TAB geometry, the side TAB actuators 110 and 120, which are oriented to actuate toward each other, can provide sufficient force, upon heating, to compress the center arched beam(s) 150, and cause significant deflection of the actuated elements 170 attached to the center beams. Thus, the device may be described as a mechanism for changing mechanical advantage. In particular, the relatively large force and small displacement actuation of the side actuators 110/120 is converted to a relatively low force and relatively large displacement actuation in the center beam 150. Displacement of 100 $\mu$m may be achieved with applied power less than 0.5 watts in silicon-based versions of embodiments of these actuators.

Figure 1B:
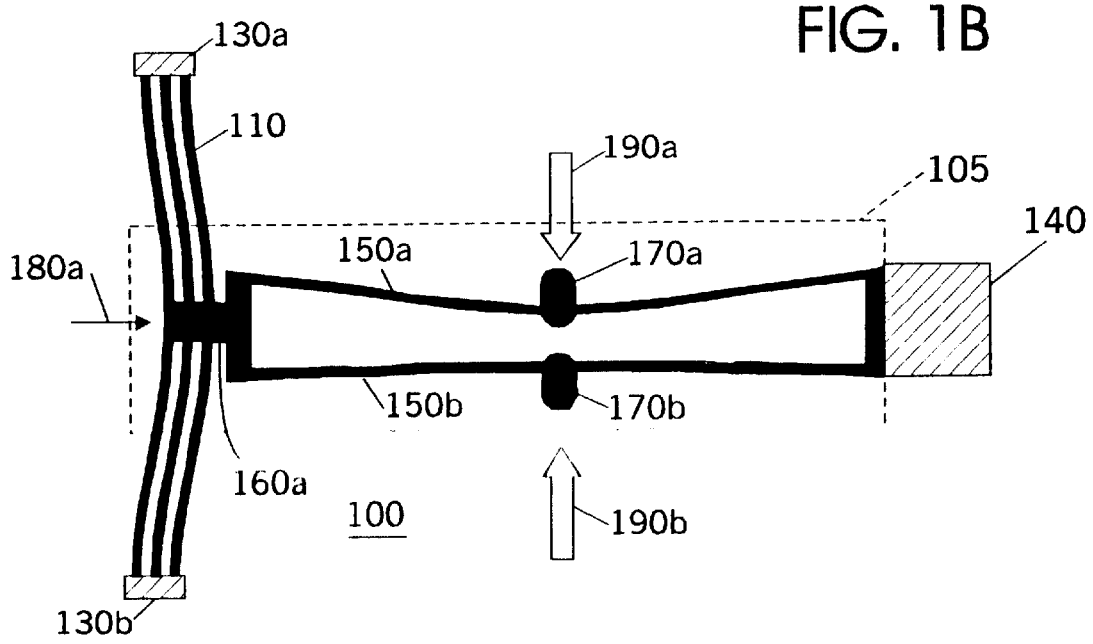

FIG. 1B illustrates other embodiments wherein only one end portion of the respective driven arched beams are driven by a thermal arched beam(s). Thus, T-TAB geometries are provided, wherein the leg of the T-shaped body comprises a plurality of mechanically activated arched beams 150*a* and 150*b,* and the cross-member of the T-shaped body comprises at least one thermal arched beam 110. More specifically, the thermal arched beam(s) 110 extend on a substrate 100 between spaced apart supports 130*a* and 130*b,* for movement along a direction shown by displacement arrow 180*a,* upon thermal actuation thereof. The intermediate portion(s) of the thermal arched beams 110 are coupled to an end portion of the driven arched beams 150*a* and 150*b,* for example using a coupler 160*a*. The other end(s) of the driven arched beams 150*a* and 150*b* are fixedly anchored by at least one anchor 140. Multiple driven arched beams 150*a* and 150*b* include actuated elements 170*a* and 170*b* respectively. As shown, the actuated elements 170*a* and 170*b* move in a displacement direction shown by arrows 190*a* and 190*b,* respectively, upon movement of the intermediate portion of the thermal arched beams 110 in a displacement direction shown by arrow 180*a*. A mechanical advantage may be obtained as shown by displacement arrows 190*a* and 190*b*.

The embodiments of FIG. 1B may be regarded as single-side versions of the H-TAB actuator shown in FIG. 1A, and may referred to as a T-TAB. The T-TAB can work similarly to the H-TAB, but may have different power/displacement performance characteristics. The device also may have a smaller footprint than an H-TAB of FIG. 1A. An application of FIGS. 1A and 1B can cause the two actuated elements 170*a* and 170*b* that are coupled to the respective driven beams 150*a* and 150*b,* to actuate toward one another and contact one another, thereby providing a switch. Many other applications may be envisioned.

Figure 2A:
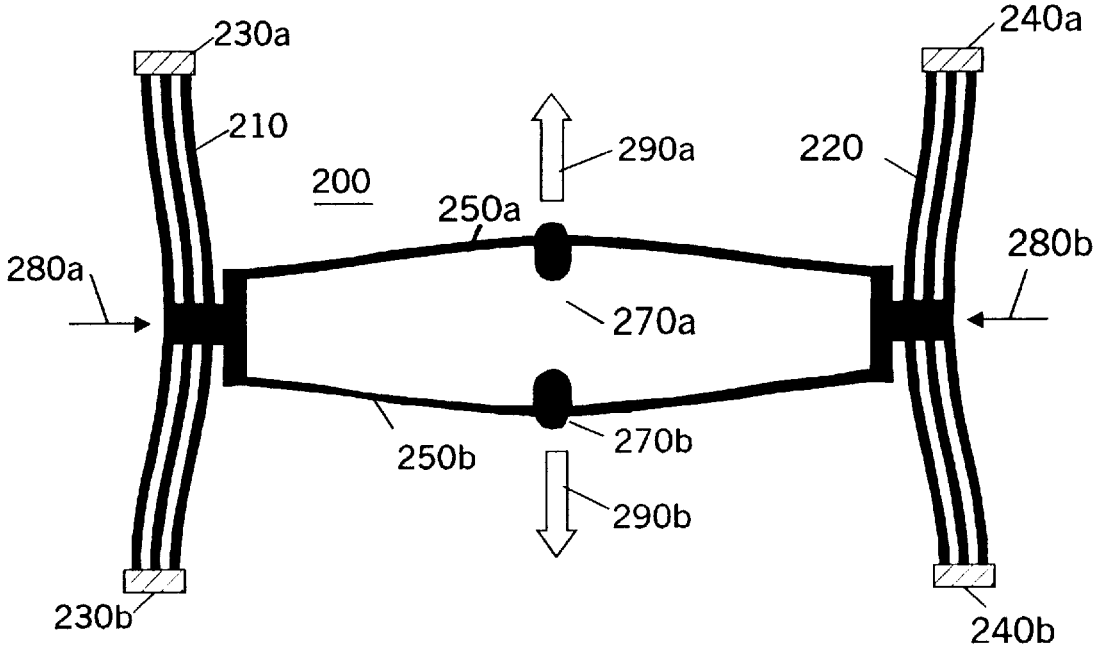

FIG. 2A illustrates alternative embodiments of microelectromechanical actuators wherein the first and second driven arched beams 250*a* and 250*b* further arch away from one another in opposite directions 290*a* and 290*b,* to cause actuated elements 270*a* and 270*b* to move away from one another, in response to actuation of first and second thermal arched beams 210 and 220 that extend between spaced apart supports 230*a,* 230*b* and 240*a,* 240*b* on a substrate 200. The thermal arched beams 210 and 220 actuate toward each other in the directions indicated by displacement arrows 280*a* and 280*b*.

Figure 2B:
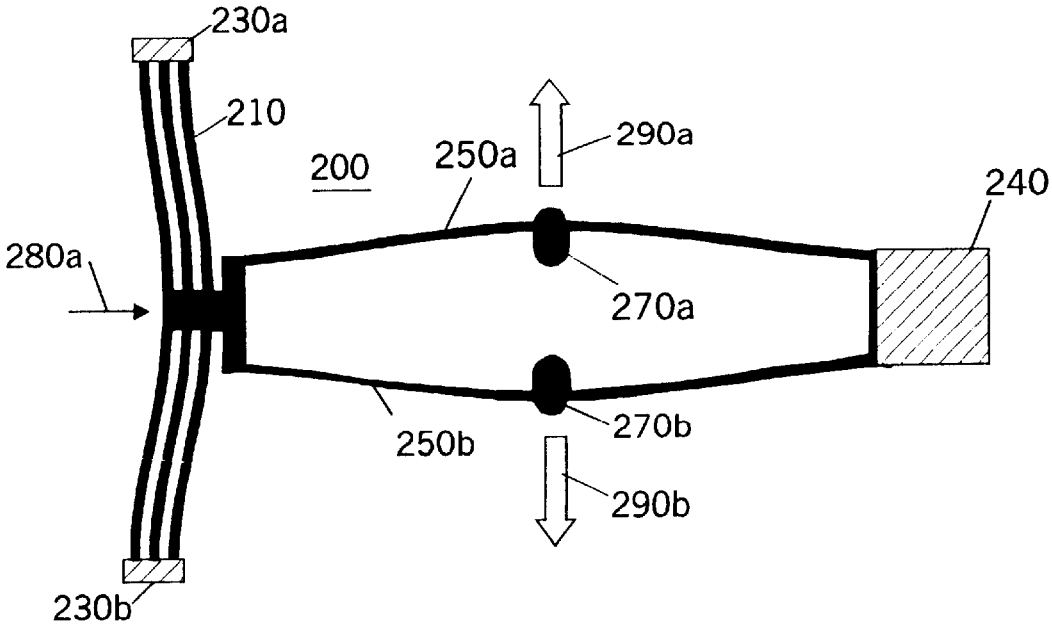

FIG. 2B illustrates analogous embodiments wherein at least one thermal arched beam 210 is used to couple to one end of the driven arched beams 250*a* and 250*b*. The other end of driven arched beams 250*a* and 250*b* is fixed by a fixed anchor 240.

Figure 3A:
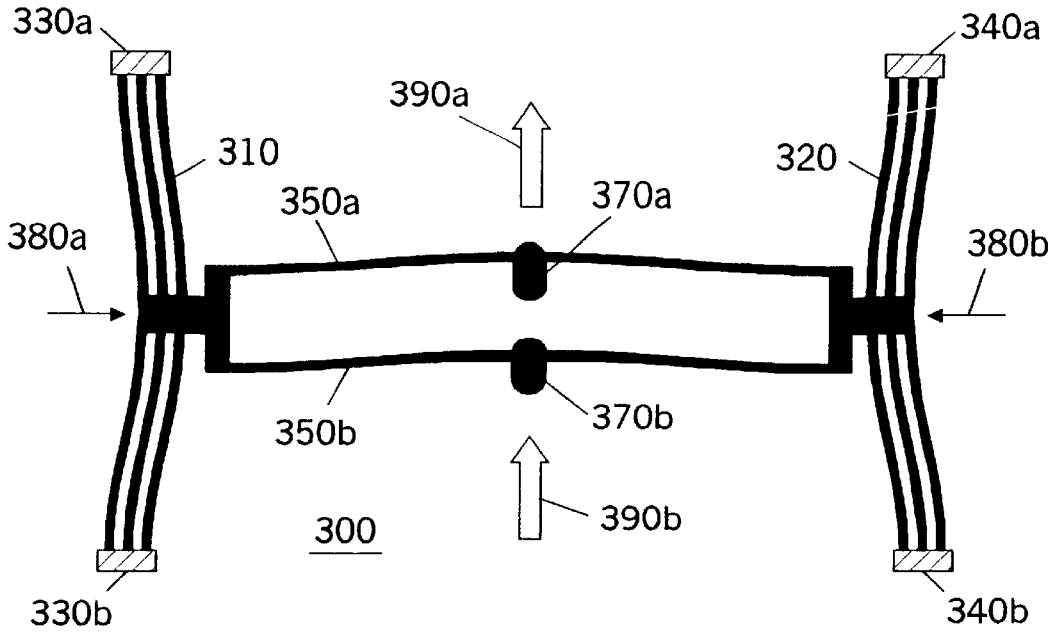

FIG. 3A illustrates other embodiments wherein the first and second driven arched beams 350*a* and 350*b* extend parallel to one another between the first thermal arched beam(s) 310 and the second thermal arched beam(s) 320 that extend between pairs of spaced apart supports 330*a,* 330*b* and 340*a,* 340*b* on a substrate 300. Thus, in response to actuation of the first and second thermal arched beams 310 and 320 in the first and second opposite directions shown by displacement arrows 380*a* and 380*b,* the first and second driven arched beams both actuate in the same direction indicated by displacement arrows 390*a* and 390*b*. The actuated elements 370*a* and 370*b* move relative to the substrate, but not relative to one another when the driven arched beams are the same size and scope. Embodiments of FIG. 3A can be used for parallel contacts such as parallel current pads in microrelay or other applications. Many other applications can be envisioned. Multiple actuated elements may have many applications in optical shutter and/or electrical relay technology.

Figure 3B:
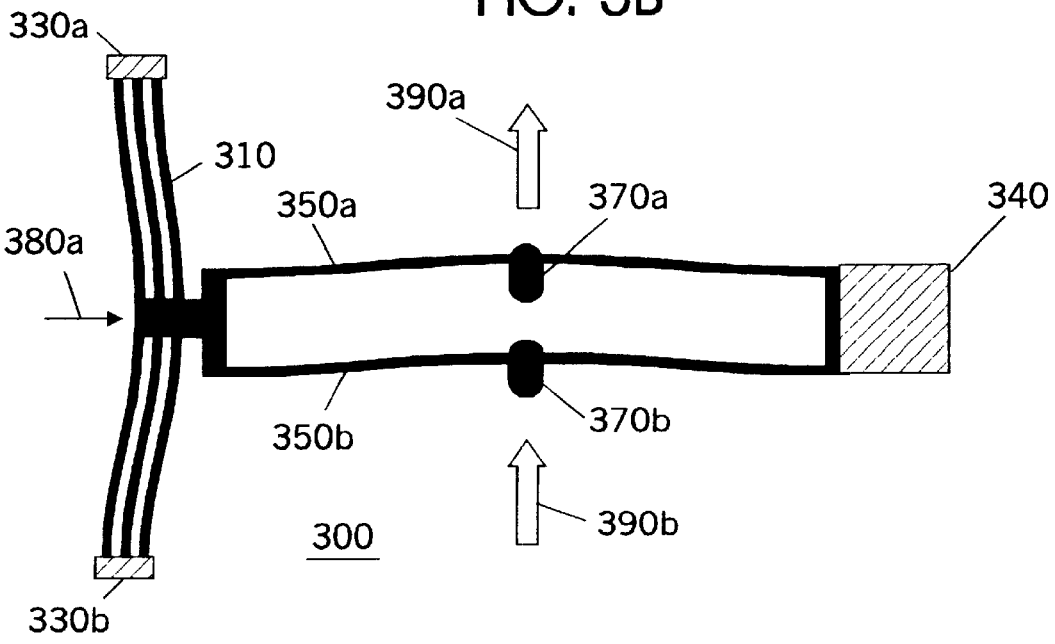

FIG. 3B illustrates embodiments that are similar to FIG. 3A, except that the first and second driven arched beams 350*a* and 350*b* are driven only at one end and are maintained fixed at the other end by a fixed anchor 340.

Figure 4A:
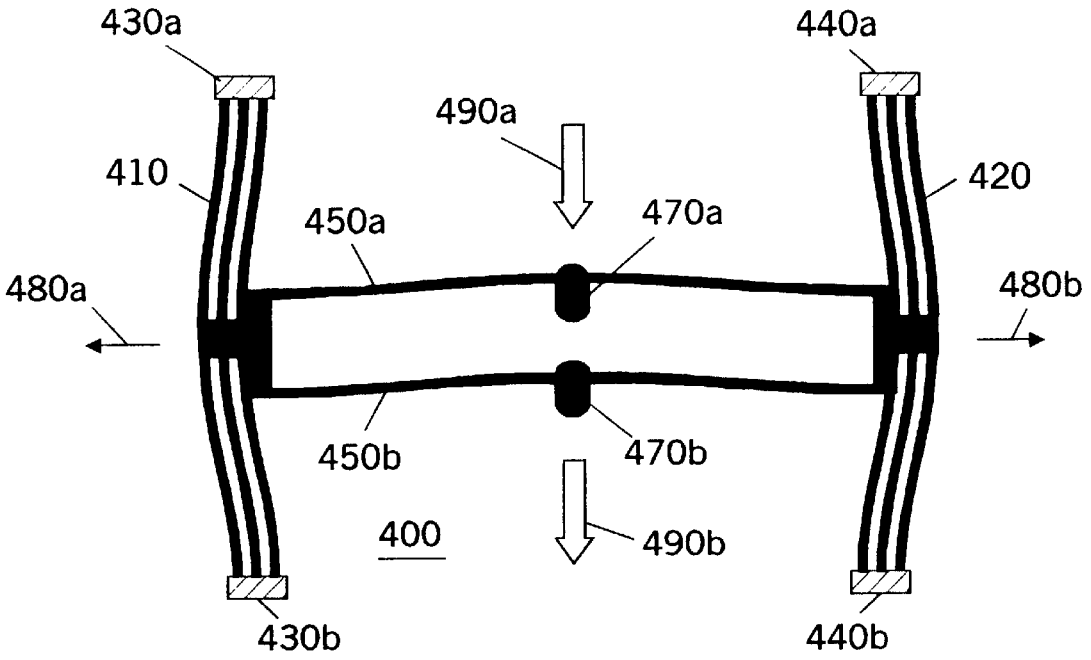

Referring now to FIG. 4A, other alternate embodiments of microelectromechanical actuators according to the present invention are shown. FIG. 4A may be contrasted with FIGS. 1A–3A, because the end portions of the driven arched beams are pulled apart by further arching of the thermal arched beam(s), to thereby decrease arching of the driven arched beams. In particular, as shown in FIG. 4A, first and second thermal arched beam(s) 410 and 420 respectively, arch in opposite directions shown by displacement arrows 480*a* and 480*b* and extend between first and second pairs of spaced apart supports 430*a,* 430*b* and 440*a,* 440*b* on a substrate 400. Accordingly, activation of the thermal arched beams 410 and 420 causes the thermal arched beams to further arch in the opposite directions indicated by displacement arrows 480*a* and 480*b,* away from each other. This causes the arching in the driven beams 450*a* and 450*b* to decrease, thereby displacing actuated elements 470*a* and 470*b* in the direction shown by displacement arrows 490*a* and 490*b*.

It will be understood that FIG. 4A illustrates embodiments wherein two driven arched beams 450*a* and 450*b* that extend parallel to one another in a manner similar to FIG. 3A. However, the driven arched beams 450*a* and 450*b* may arch toward one another in a manner similar to FIG. 1A or away from each other in a manner similar to FIG. 2A.

Figure 4B:
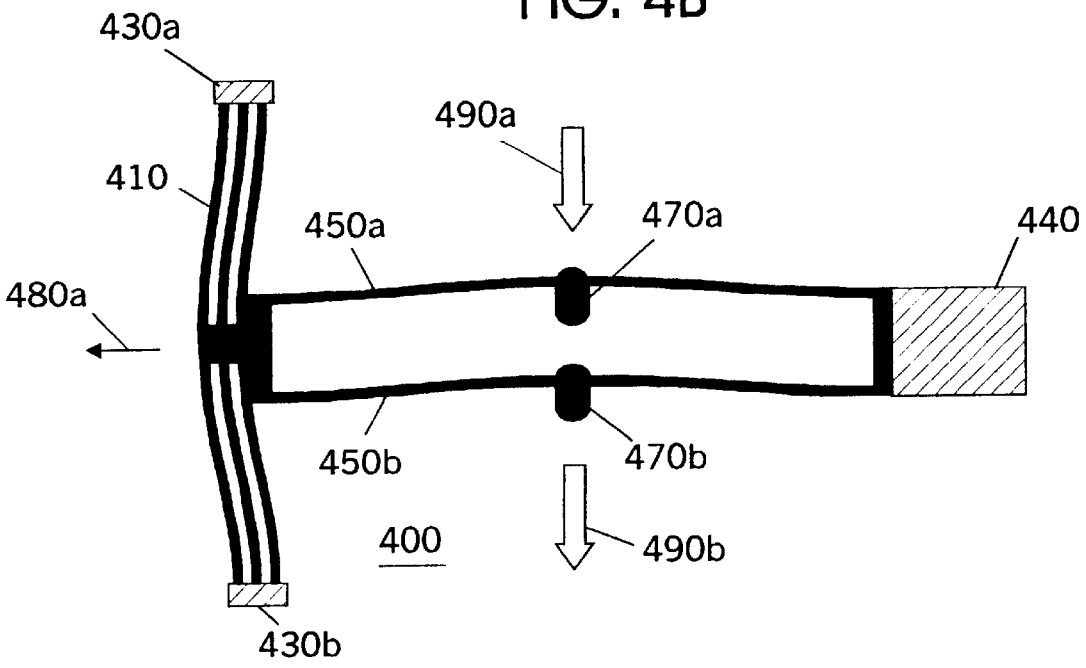

FIG. 4B illustrates similar T-TAB actuators, except that the driven arched beams 450*a* and 450*b* are driven at one end and are maintained fixed at the other end by an anchor 440. It will be understood that, similar to FIG. 4A, embodiments of driven arched beams analogous to FIGS. 1B–3B also may be provided.

Figure 5:
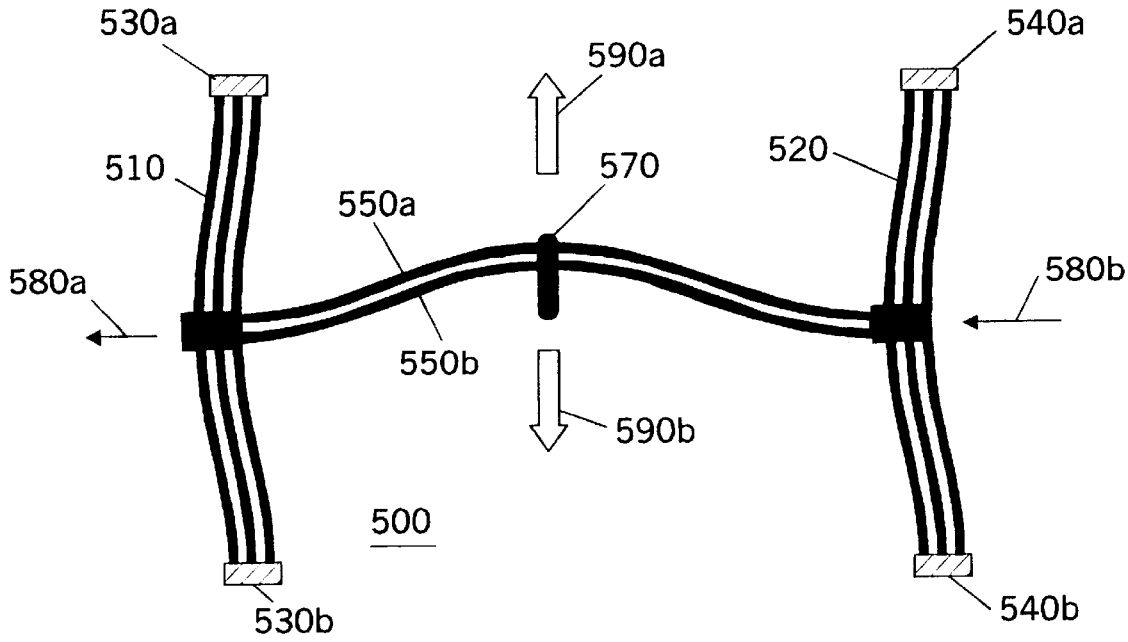

FIG. 5 illustrates other embodiments of actuators of the present invention, wherein two side TAB actuators are arranged to actuate in the same direction. Thus, at least one first thermal arched beam 510 extends between spaced apart supports 530*a* and 530*b* on a substrate 500, and further arches in a first direction 580*a,* shown as the left in FIG. 5 upon application of heat thereto. At least one second thermal arched beam 520 extends between second spaced apart supports 540*a* and 540*b* on the substrate 500, and further arches in the first direction shown by displacement arrow 580*b,* also to the left in FIG. 5. First and second driven arched beams 550*a* and 550*b* extend between the first and second thermal arched beams 510 and 520. As shown in FIG. 5, the driven arched beams may be coupled together by a single actuated element 570.

Embodiments of FIG. 5 can have many applications. For example, the first (left side) thermal arched beam(s) 510 can be used independently to actuate the driven beam in the direction shown by displacement arrow 590*b,* downward in FIG. 5. Moreover, the second (right side) thermal arched beam(s) 520 may be used to independently actuate the first and second driven beams in a displacement direction 590*a* that is opposite direction 590*b,* shown as upward in FIG. 5. Thus, a bidirectional actuator may be provided. Other applications can exploit the fact that when both the first and second thermal arched beam(s) 510 and 520 are activated, the center beam(s) does not actuate significantly in the direction 590*a* or 590*b* (although there may be some translation in the direction 580*a*). This describes an "EXCLUSIVE OR" type of logic behavior, in that the actuated element 570 only will move in the actuation direction when actuated by the first thermal arched beam(s) 510 or the second thermal arched beam(s) 520, but not both. A form of electromechanical logic gate technology based on arched beam arrays may thereby be provided. Such logic mechanisms may have advantages over traditional electronic logic circuits. It also will be understood that in the embodiment of FIGS. 1A, 2A, 3A and 4A, only one of the thermal arched beam(s) may be driven, or other beams may be driven simultaneously.

Alternate embodiments of FIG. 5 can provide first and second driven arched beams 550*a* and 550*b* that are not coupled to one another, that extend toward each other and/or extend away from each other, as was described in earlier embodiments. These configurations of driven arched beams can provide more complicated logic functions or other applications.

Figure 6A:
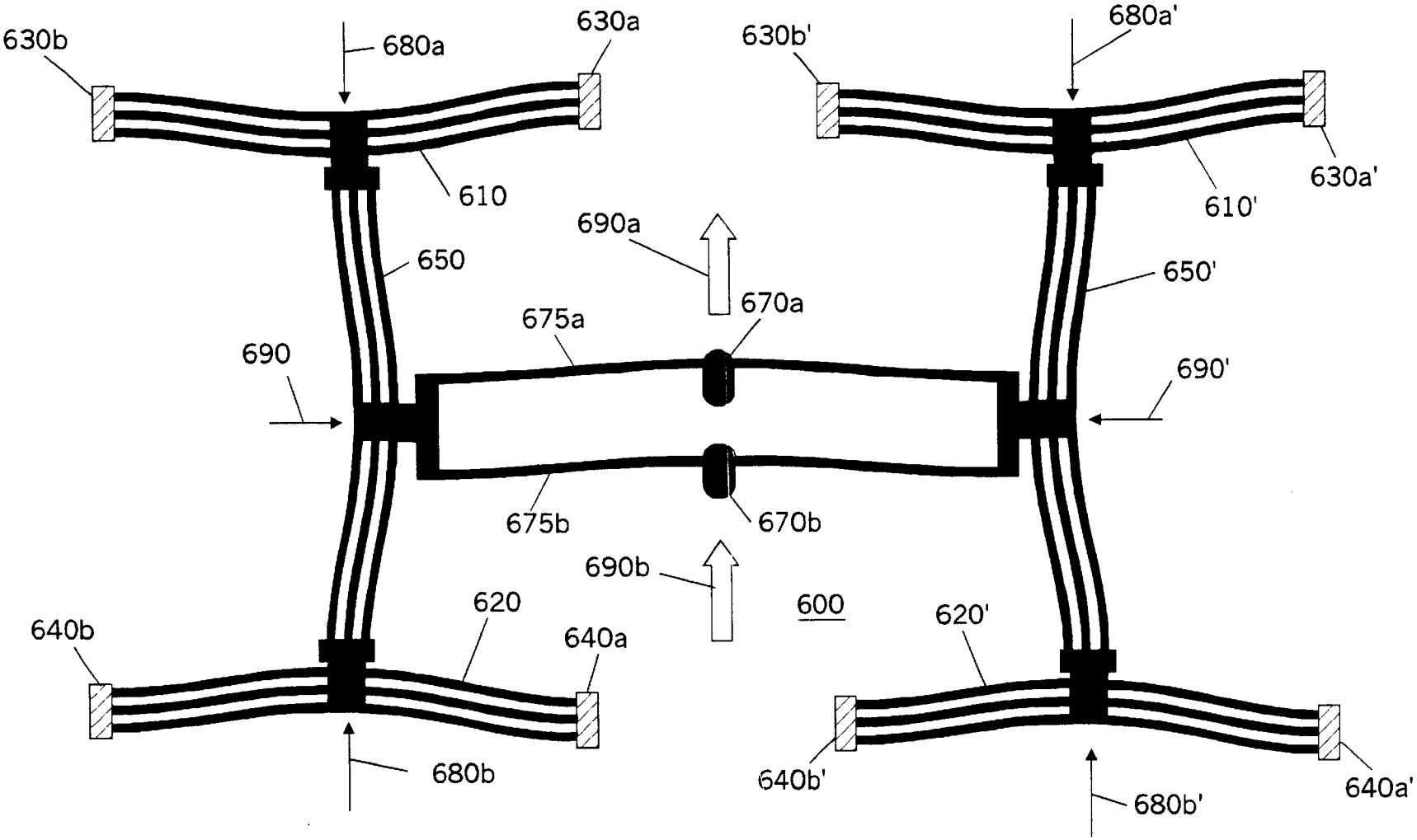
Figure 6B:
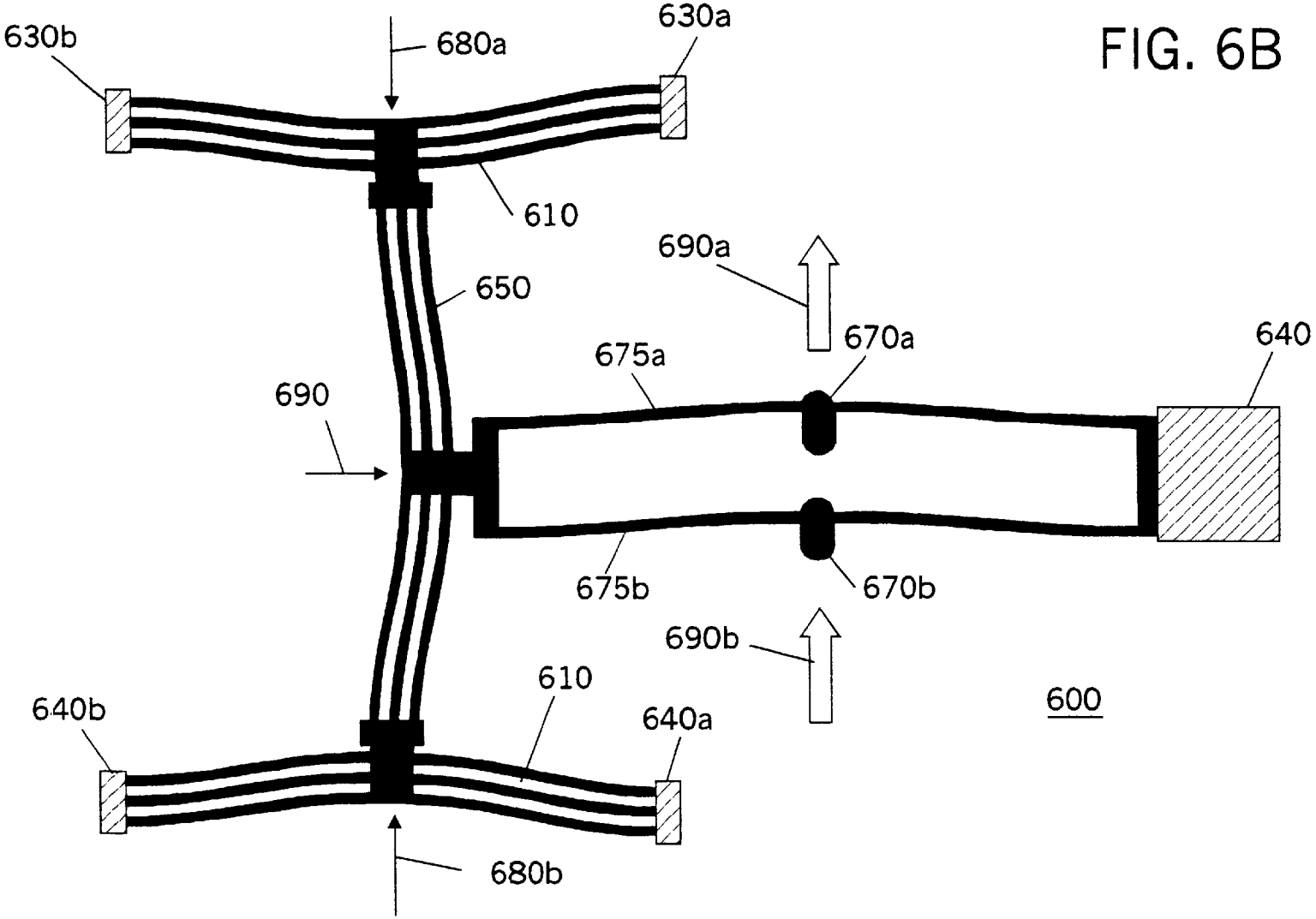

FIGS. 6A and 6B illustrate yet other embodiments wherein the driven arched beams of first and second spaced apart thermal arched beam actuators are themselves coupled together by another driven arched beam(s). These cascaded configurations may be used to obtain extremely large displacements or to obtain other improved performance properties such as lower power usage.

In particular, referring to FIG. 6A, a first driven arched beam(s) 650 is driven at the end thereof by first and second thermal arched beams 610 and 620 that extend between spaced apart supports 630*a,* 630*b* and 640*a,* 640*b* on a substrate 600. Arching of the first and second thermal arched beams 610 and 620 in the directions shown by displacement arrows 680*a* and 680*b* squeezes the ends of the driven arched beams 650*a* and 650*b* to cause displacement of the actuated elements 675*a* and 675*b* in the directions shown by displacement arrows 690*a* and 690*b*. A mirror image of this structure is provided, including third and fourth thermal arched beams 610' and 620' and a second driven arched beam(s) 650', with the corresponding elements indicated by prime notation. At least one third driven arched beam 675 is coupled between the first and second driven arched beams 650 and 650'. More specifically, the ends of the third driven arched beam(s) 675 are coupled between the intermediate portions of the first and second thermal arched beam(s) 650 and 650'. Upon actuation of the first, second, third and fourth thermal arched beams 610, 620, 610' and 620', the ends of the third driven arched beam(s) 650*a* and 650*b* may be squeezed by a large amount due to the displacement amplification provided by the first and second driven arched beams 650 and 650', to thereby provide a large displacement of contact 670 in the direction shown by arrow 695. It will be understood that each of the actuators of FIG. 6A may be embodied using any of the previously described embodiments and the third driven arched beam(s) 675*a* and 675*b* also may be embodied using any of the previously described embodiments. It also will be understood that not all of thermal arched beams 610, 620, 610' and 620' need be actuated simultaneously.

FIG. 6B is similar to FIG. 6A, except it describes a third driven arched beam that is driven at one end only by an H-TAB actuator. The other end of the third driven arched beams 675 is fixed by an anchor 640.

Figure 7A:
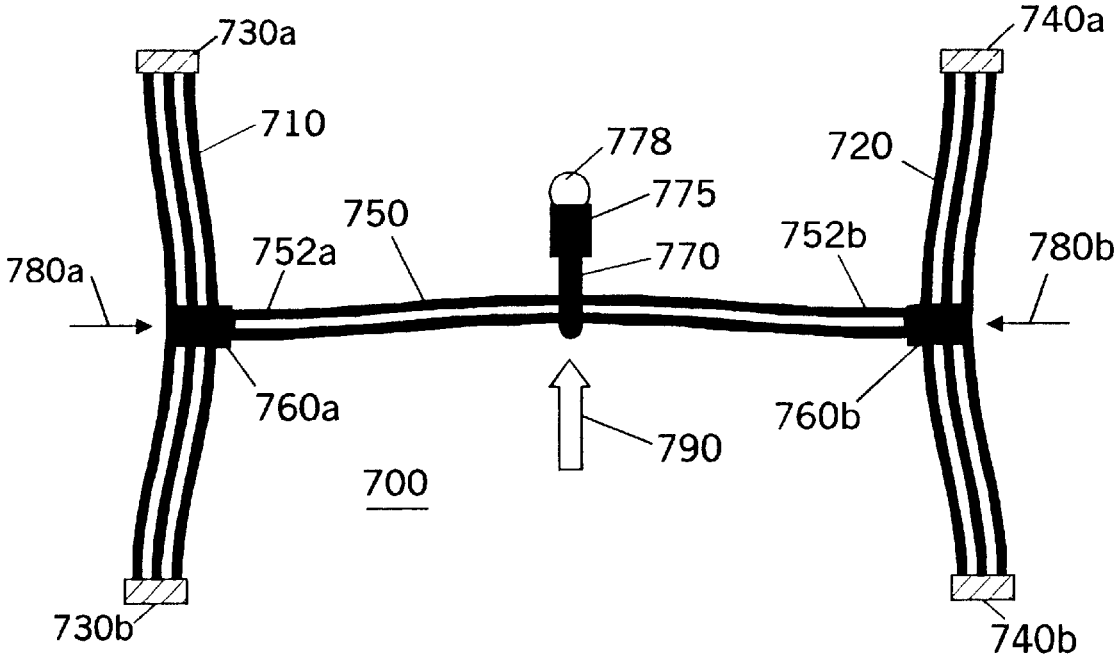

FIG. 7A illustrates embodiments of the present invention that may be used to form a Variable Optical Attenuator (VOA) and/or an optical switch (a binary optical attenuator). FIG. 7A illustrates an H-TAB VOA that includes at least one first thermal arched beam 710 between first spaced apart supports 730*a* and 730*b* on a substrate 700 and at least one second thermal arched beam 720 between second spaced apart supports 740*a* and 740*b* on the substrate 700. At least one driven arched beam 750 is coupled between the first and second thermal arched beams 710 and 720, for example using couplers 760*a* and 760*b*. When the first and second thermal arched beams 710 and 720 displace towards one another as shown by displacement arrows 780*a* and 780*b,* the at least one driven arched beam 750 moves in the direction 790.

In FIG. 7A, the two thermal arched beams 750 are shown coupled together by a coupler 770. A paddle 775 is attached to the coupler 770. It will be understood that the paddle 775 and the coupler 770 may form one integral structure. The paddle 775 is oriented so as to selectively cover an end of an optical fiber 778 that passes through the substrate 700, for example orthogonal or at an oblique angle to the substrate face. Upon displacement in the direction 790, variable or binary optical attenuation of optical radiation through the fiber 778 may be provided. Thus, VOAs with high precision, low power and/or small footprint may be provided. It also will be understood that the paddle 775 and coupler 770 may be configured such that attenuation may be provided upon displacement in a direction that is opposite the direction 790.

Figure 7B:
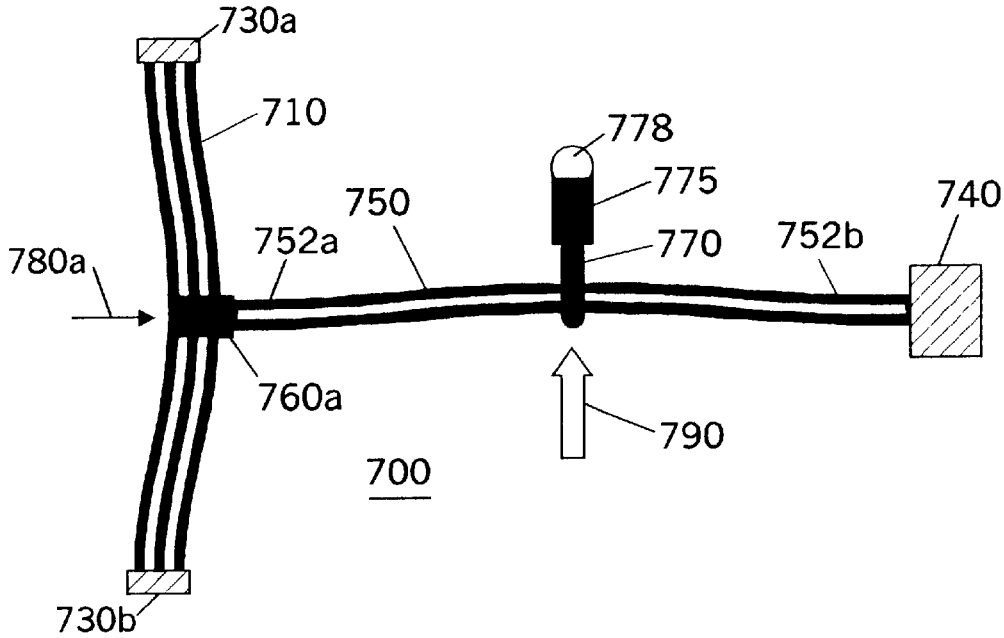

FIG. 7B illustrates embodiments of analogous T-TAB VOAs wherein a fixed support 740 is used rather than a second thermal arched beam(s).

Figure 8A:
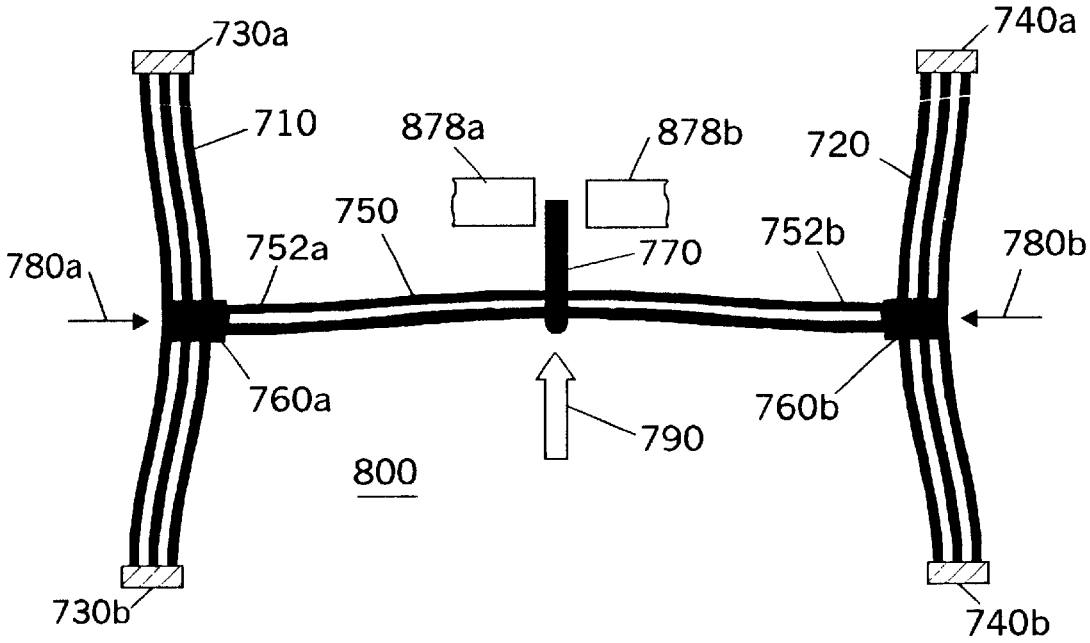
Figure 8B:
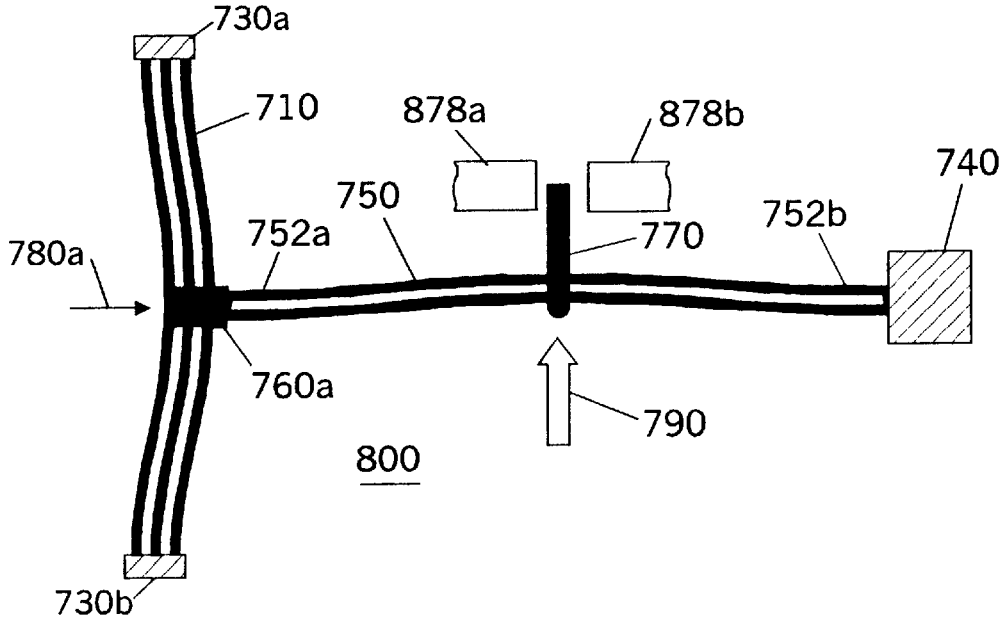

FIGS. 8A and 8B illustrate alternative embodiments of H-TAB VOAs and T-TAB VOAs, respectively. In these embodiments, two ends of optical fibers 878*a* and 878*b* extend along the substrate 800 and the integrated paddle/coupler 770 selectively attenuates optical radiation passing between the fiber ends 878*a* and 878*b*. It also will be understood that all the other embodiments that are described herein may be used to provide VOAs for one or more fibers.

Figure 9A:
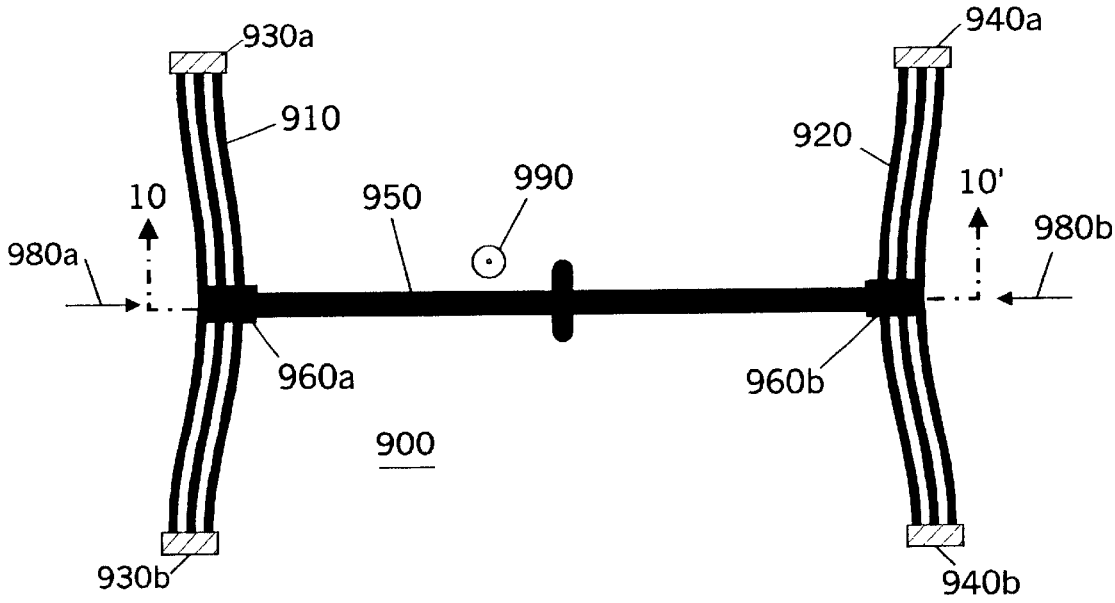
Figure 9B:
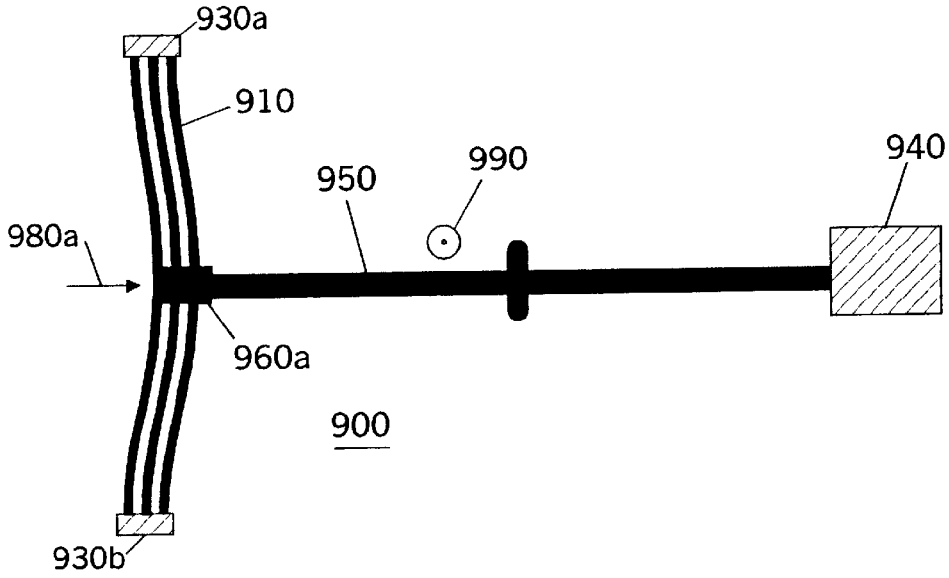

Referring now to FIGS. 9A and 9B, other embodiments of H-TAB and T-TAB actuators according to the present invention as shown. In contrast with the earlier embodiments, these actuators can provide "out of plane" actuation wherein the driven beams arches in a direction that is nonparallel to the substrate. The driven beam includes end portions that move relative to one another to arch the driven beam in a direction that is nonparallel to the substrate in response to the further arching of the thermal arched beam(s) for movement of the driven beam toward or away from the substrate.

More specifically, as shown in FIG. 9A, first and second thermal arched beam(s) 910 and 920 are included on a substrate 900 and are supported by first and second pairs of spaced apart supports 930*a,* 930*b* and 940*a,* 940*b* for actuation in the displacement directions shown by displacement arrows 980*a* and 980*b*. A driven beam such as a driven arched beam 950 is coupled to the first and second thermal arched beams 910 and 920, for example using couplers 960*a* and 960*b*. As shown in FIG. 9A, the driven beam 950 preferably is wider than the thermal arched beams 910 and 920 when viewed from above, so that arching along the substrate is not promoted. Moreover, as will be described below, the driven beam 950 preferably is thin in cross-section to promote arching out of the plane of the substrate as shown by displacement indicator 990. FIG. 9B illustrates a similar T-TAB configuration that uses a fixed support 940 rather than a second thermal arched beam(s) 920.

Figure 10A:
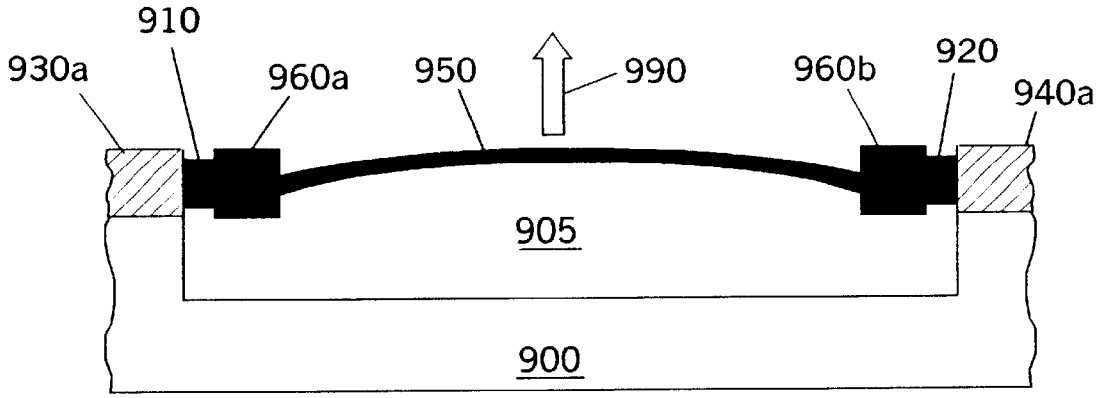
FIGS. 10A–10C are cross-sectional views of alternate embodiments of microelectromechanical actuators of FIG. 9A, taken along line 10–10' thereof.
Figure 10B:
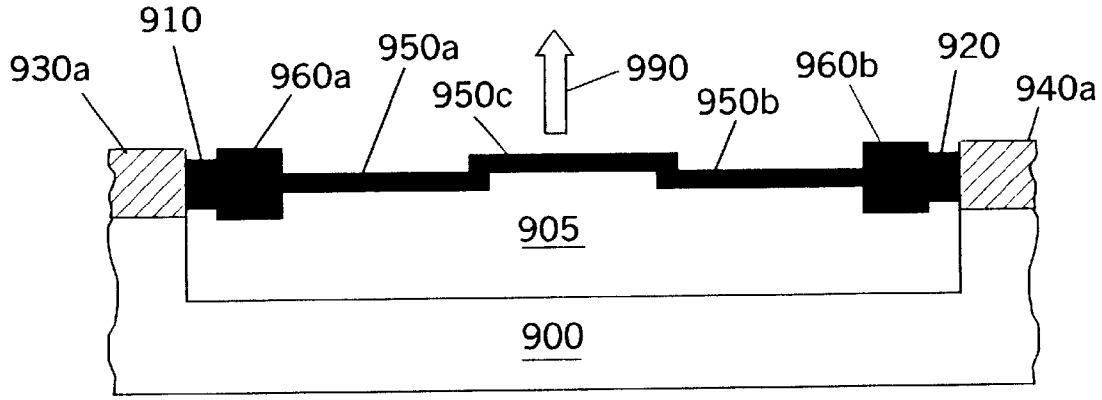
Figure 10C:
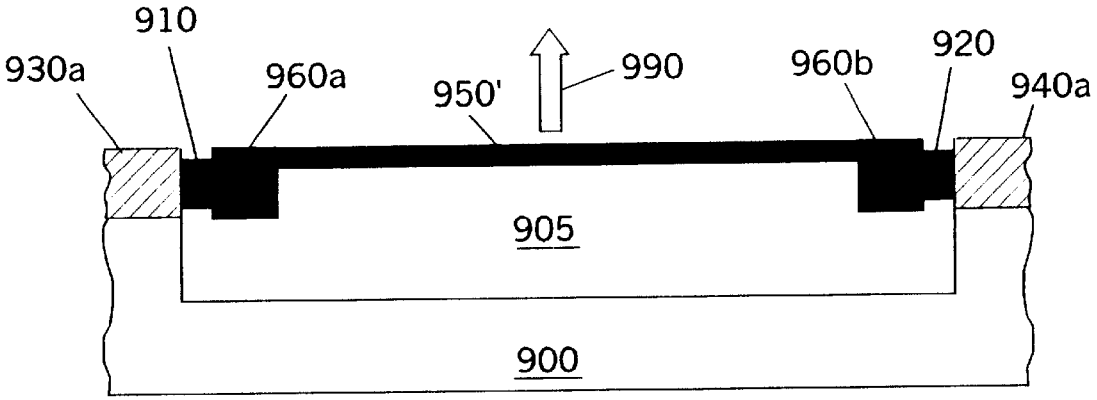

FIGS. 10A–10C are cross-sectional views of FIG. 9A along line 10–10' to illustrate the arching of the driven beam 950 out of the plane of the substrate 900.

Referring now to FIG. 10A, the substrate 900 includes an optional trench 905 that can reduce stiction and can provide clearance for the out of plane arched beam 950. As can be seen from FIG. 10A, the driven arched beam 950 is thin in cross-section relative to the thermal arched beams 910 and 920, so that displacement occurs in the displacement direction 990 as shown.

FIG. 10A illustrates arching that may be provided by a continuous driven arched beam 950. In contrast, FIG. 10B illustrates arching that may be provided by a stepped arched beam that includes a pair of end sections 950*a* and 950*b* and a center section 950*c* that is offset from the end sections 950*a* and 950*b*. If the center section 950*c* is offset beneath the end sections 950*a* and 950*b*, arching toward the substrate 900 may be provided.

FIG. 10C illustrates yet another embodiment wherein the combination of the coupler 960 and a straight beam 950' may provide an equivalent to an arched beam by biasing the beam to arch in the displacement direction 990 as shown.

It also will be understood that multiple driven arched beams 950 may be provided that arch in the same or opposite directions as was illustrated in connection with FIGS. 1–6 above. Moreover, out of plane variable optical attenuators similar to those which were disclosed in FIGS. 7 and 8 also may be provided. Finally, it also will be noted that although arching is shown orthogonal to the substrate, arching may be provided at any oblique angle to the substrate.

Figure 11A:
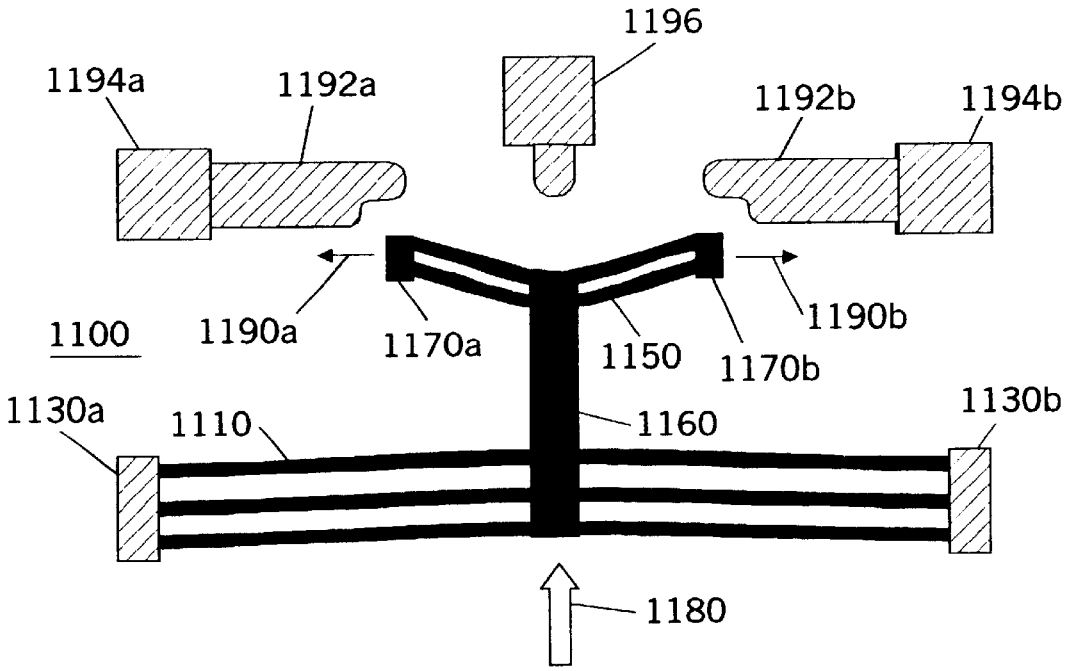

FIG. 11A describes other embodiments of microelectromechanical actuators according to the present invention. In these embodiments, a relatively large displacement and relatively small force of a TAB actuator is converted to a relatively large force and relatively small displacement in at least one driven arched beam. Accordingly, the mechanical advantage of the driven arched beam may be reversed compared to FIGS. 1–10.

More particularly, referring to FIG. 11A, at least one thermal arched beam 1110 extends between spaced apart supports 1130*a* and 1130*b* on a substrate 1100. Actuation of the thermal arched beam(s) 1110 causes the intermediate portion thereof, to move in a first direction indicated by displacement arrow 1180. The thermal arched beam(s) 1110 is coupled to an intermediate portion of a driven arched beam(s) 1150, for example using a coupler 1160. Accordingly, upon actuation, the end portion(s) of the driven arched beam(s) 1150 are driven against a pair of fixed supports 1192*a*, 1192*b* and slide along the fixed supports 1192*a*, 1192*b* in the directions shown by displacement arrows 1190*a* and 1190*b*.

Microelectromechanical actuators of FIG. 11A may be embodied as a "shorting bar" microrelay. In these applications, the thermal arched beam(s) 1110 is used to drive contacts 1170*a* and/or 1170*b* at the ends of a driven arched beam(s) 1150 into a pair of fixed contacts 1192*a* and 1192*b*, to which signals may be applied at signal pads 1194*a*, 1194*b*. The contacts 1170*a* and 1170*b* at the end of the driven arched beam(s) 1350 are driven against the rigid contacts 1192*a* and 1192*b* and then slide along the rigid contacts 1192*a* and 1192*b* along the respective directions 1190*a* and 1190*b*. Thus, the relatively large displacement of the thermal arched beam 1110 can be converted to a relatively large force at the two points of contact between the contacts 1170*a* and 1170*b* and the fixed contacts 1192*a* and 1192*b*. A mechanical stop 1196 may be used to prevent snap-through buckling of the driven arched beams.

Figure 11B:
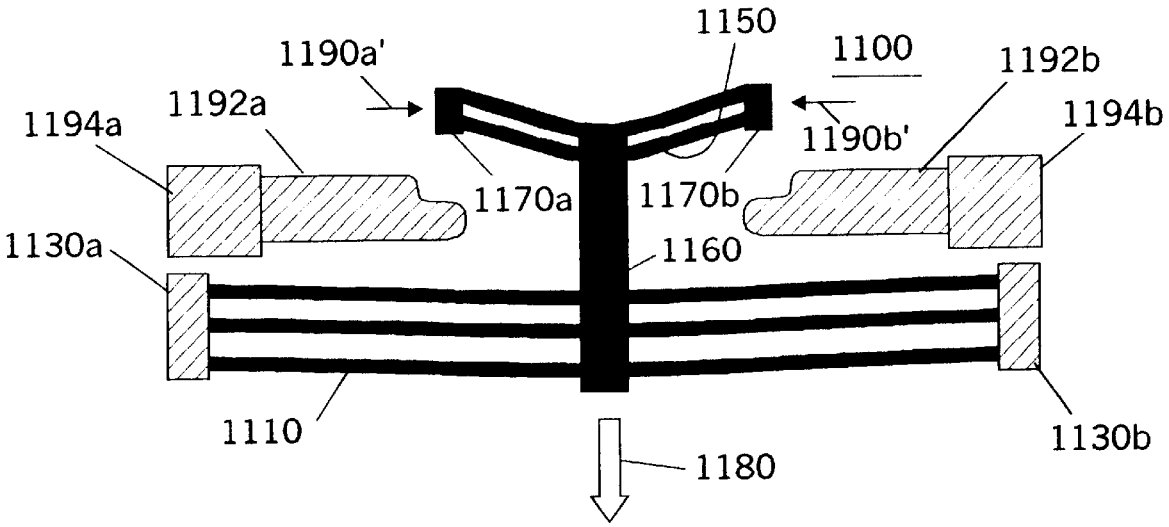

FIG. 11B illustrates other embodiments wherein further arching of the thermal arched beam(s) 1110 causes the ends of the driven arched beam(s) 1150 to move toward one another in directions 1190*a*' and 1190*b*'. Like elements are indicated by prime notation. Many other embodiments may be envisioned.

There can be many uses for embodiments of microelectromechanical actuators according to the present invention. Optical applications may be envisioned, such as using an H-TAB actuator to drive variable optical attenuators and/or optical crossconnect switching devices. Electrical and/or radio frequency applications, such as using an H-TAB actuator to drive a microrelay or variable capacitor/inductor also may be provided. A thermostat may be provided wherein the thermal arched beam further arches upon heating thereof by ambient heat of an ambient environment in which the microelectromechanical actuator is present. Other applications, such as using these actuator arrays for microfluidic control or micropneumatic control, may be provided. Accordingly, one or more of the driven arched beams may be coupled to other elements, such as relay contacts, optical attenuators, variable circuit elements such as resistors and capacitors, valves and circuit breakers. Many other configurations and applications that use cascaded arched beams, both thermal and mechanical in order to change mechanical advantage also may be provided.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A microelectromechanical actuator comprising:

a substrate;

spaced apart supports on the substrate;

a thermal arched beam that extends between the spaced apart supports and that further arches upon heating thereof for movement parallel the substrate; and a driven beam that is coupled to the thermal arched beam, the driven beam including end portions that move relative to one another to arch the driven beam in a direction that is nonparallel to the substrate in response to the further arching of the thermal arched beam, for movement of the driven beam toward or away from the substrate.

2. A microelectromechanical actuator according to claim 1 wherein the end portions are squeezed together by the further arching of the thermal arched beam to thereby increase arching of the driven beam.

3. A microelectromechanical actuator according to claim 1 wherein the end portions are pulled apart by the further arching of the thermal arched beam to thereby decrease arching of the driven beam.

4. A microelectromechanical actuator according to claim 1 wherein the thermal arched beam includes an intermediate portion between end portions thereof, wherein the driven beam includes an intermediate portion between the end portions thereof and wherein the intermediate portion of the thermal arched beam is coupled to one of the end portions of the driven beam.

5. A microelectromechanical actuator according to claim 4 further comprising an anchor that anchors the other end portion of the driven beam to the substrate.

6. A microelectromechanical actuator according to claim 1:

wherein the driven beam arches in a direction that is orthogonal to the substrate by the further arching of the thermal arched beam for movement orthogonal to the substrate.

7. A microelectromechanical actuator according to claim 1 wherein the driven beam is a driven arched beam that is arched in the direction that is nonparallel to the substrate, such that the arching of the driven arched beam is changed in the direction that is nonparallel to the substrate in response to the further arching of the thermal arched beam.

8. A microelectromechanical actuator according to claim 1 wherein the spaced apart supports are first spaced apart supports and wherein the thermal arched beam is a first thermal arched beam, the thermal arched beam microelectromechanical actuator further comprising:

second spaced apart supports on the substrate;

a second thermal arched beam that extends between the second spaced apart supports and that further arches upon heating thereof for movement parallel to the substrate; and wherein the driven beam is coupled to the first and second thermal arched beams, such that the end portions thereof move relative to one another to arch the driven beam in the direction that is nonparallel to the substrate in response to the further arching of the first and second thermal arched beams.

9. A microelectromechanical actuator according to claim 8 wherein the first and second thermal arched beams each include an intermediate portion between end portions, wherein the driven beam includes an intermediate portion between the end portions thereof, wherein the intermediate portion of the first thermal arched beam is coupled to one end portion of the driven beam and wherein the intermediate portion of the second thermal arched beam is coupled to the other end portion of the driven beam.

10. A microelectromechanical actuator according to claim 1 in combination with at least one of a relay contact, an optical attenuator, a variable circuit element, a valve and a circuit breaker that is mechanically coupled to the driven arched beam for actuation thereby.

11. A microelectromechanical actuator according to claim 1 wherein the thermal arched beam further arches upon heating thereof by ambient heat of an ambient environment in which the microelectromechanical actuator is present, to thereby provide a thermostat.

12. A microelectromechanical actuator according to claim 1 wherein the driven beam is a first driven arched beam and wherein the direction that is nonparallel to the substrate is a first direction that is nonparallel to the substrate, the microelectromechanical actuator further comprising:

a second driven arched beam that is coupled to the thermal arched beam and that is arched in a second direction that is nonparallel to the substrate, the second driven arched beam including end portions that move relative to one another to change the arching of the second driven arched beam in the second direction that is nonparallel to the substrate in response to the further arching of the thermal arched beam for movement of the second driven arched beam toward or away from the substrate.

13. A microelectromechanical actuator according to claim 12 wherein the first and second driven arched beams extend parallel to one another and nonparallel to the substrate such that the arching of the first and second driven arched beams changes in a same direction by the further arching of the thermal arched beam.

14. A microelectromechanical actuator according to claim 13 further comprising a coupler that mechanically couples the first and second driven arched beams.

15. A microelectromechanical actuator according to claim 12 wherein the first and second driven arched beams arch away from one another such that the arching of the first and second driven arched beams changes in opposite directions by the further arching of the thermal arched beam.

16. A microelectromechanical actuator according to claim 12 wherein the first and second driven arched beams arch toward one another such that the arching of the first and second driven arched beams changes in opposite directions by the further arching of the thermal arched beam.

17. A microelectromechanical actuator according to claim 1 wherein the spaced apart supports are first spaced apart supports, wherein the thermal arched beam is a first thermal arched beam and wherein the driven beam is a third driven beam, the microelectromechanical actuator further comprising:

second spaced apart supports on the substrate;

a second thermal arched beam that extends between the second spaced apart supports and that further arches upon heating thereof for movement parallel to the substrate;

a first driven arched beam that is coupled to the first thermal arched beam, the first driven arched beam including end portions that move relative to one another to change the arching of the first driven arched beam in response to the further arching of the first thermal arched beam for movement of the second driven arched beam parallel to the substrate; and a second driven arched beam that is coupled to the second thermal arched beam, the second driven arched beam including end portions that move relative to one another to change the arching of the second driven arched beam in response to the further arching of the thermal arched beam for movement of the second driven arched beam parallel to the substrate;

wherein the third driven beam is coupled to the first and second driven arched beams, the third driven beam including end portions that move relative to one another to arch the third driven beam in the direction that is nonparallel to the substrate in response to the changed arching of the first and second driven arched beams.

18. A microelectromechanical actuator according to claim 17 further comprising:

a fourth driven beam that is coupled to the first and second driven arched beams, the fourth driven beam including end portions that move relative to one another to arch the fourth driven beam in response to the changed arching of the first and second driven arched beams.

19. A microelectromechanical actuator according to claim 18 wherein the third and fourth driven beams are third and fourth driven arched beams that extend parallel to one another and nonparallel to the substrate such that the arching of the third and fourth driven arched beams changes in a same direction by the further arching of the first and second thermal arched beams.

20. A microelectromechanical actuator according to claim 19 further comprising a coupler that mechanically couples the third and fourth driven arched beams.

21. A microelectromechanical actuator according to claim 18 wherein the third and fourth driven beams arch away from one another such that the arching of the third and fourth driven beams changes in opposite directions by the further arching of the first and second thermal arched beams.

22. A microelectromechanical actuator according to claim 18 wherein the third and fourth driven beams arch toward one another such that the arching of the third and fourth driven beams changes in opposite directions by the further arching of the first and second thermal arched beams.

23. A microelectromechanical actuator comprising:

a substrate;

an actuator on the substrate that includes a driver beam that moves parallel to the substrate upon actuation of the actuator; and a driven beam that is coupled to the driver beam, the driven beam including end portions that move relative to one another to arch the driven beam in a direction that is nonparallel to the substrate in response to the movement of the driver beam parallel to the substrate.

24. A microelectromechanical actuator according to claim 23 wherein the end portions are squeezed together by the movement of the driver beam to thereby increase arching of the driven beam.

25. A microelectromechanical actuator according to claim 23 wherein the end portions are pulled apart by the movement of the driver beam to thereby decrease arching of the driven beam.

26. A microelectromechanical actuator according to claim 23 wherein the driven beam includes an intermediate portion between the end portions thereof and wherein the driver beam is coupled to one of the end portions of the driven beam.

27. A microelectromechanical actuator according to claim 26 further comprising an anchor that anchors the other end portion of the driven beam to the substrate.

28. A microelectromechanical actuator according to claim 23 wherein the driven beam is a driven arched beam that is arched in the direction that is nonparallel to the substrate, such that the arching of the driven arched beam is changed in the direction that is nonparallel to the substrate in response to the movement of the driver beam.

29. A microelectromechanical actuator according to claim 23 wherein the actuator is a first actuator and wherein the driver beam is a first driver beam, the microelectromechanical actuator further comprising:

a second actuator on the substrate that includes a second driver beam that moves parallel to the substrate upon actuation of the second actuator; and wherein the driven beam is coupled to the first and second driver beams, such that the end portions thereof move relative to one another to arch the driven beam in the direction that is nonparallel to the substrate in response to the movement of the first and second driver beams along the substrate.

30. A microelectromechanical actuator according to claim 29 wherein the driven beam includes an intermediate portion between the end portions thereof, wherein the first driver beam is coupled to one end portion of the driven beam and wherein the second driver beam is coupled to the other end portion of the driven beam.

31. A microelectromechanical actuator according to claim 23 in combination with at least one of a relay contact, an optical attenuator, a variable circuit element, a valve and a circuit breaker that is mechanically coupled to the driven arched beam for actuation thereby.

32. A microelectromechanical actuator according to claim 23 wherein the driven beam is a first driven arched beam and wherein the direction that is nonparallel to the substrate is a first direction that is nonparallel to the substrate, the microelectromechanical actuator further comprising:

a second driven arched beam that is coupled to the driver beam and that is arched in a second direction that is nonparallel to the substrate, the second driven arched beam including end portions that move relative to one another to change the arching of the second driven arched beam in the second direction that is nonparallel to the substrate in response to the movement of the driver beam.

33. A microelectromechanical actuator according to claim 32 wherein the first and second driven arched beams extend parallel to one another and nonparallel to the substrate such that the arching of the first and second driven arched beams changes in a same direction by the movement of the driver beam.

34. A microelectromechanical actuator according to claim 33 further comprising a coupler that mechanically couples the first and second driven arched beams.

35. A microelectromechanical actuator according to claim 33 wherein the first and second driven arched beams arch away from one another such that the arching of the first and second driven arched beams changes in opposite directions by the movement of the driver beam.

36. A microelectromechanical actuator according to claim 33 wherein the first and second driven arched beams arch toward one another such that the arching of the first and second driven arched beams changes in opposite directions by the movement of the driver beam.

37. A microelectromechanical actuator according to claim 23 wherein the actuator is a first actuator, wherein the driver beam is a first driver beam and wherein the driven beam is a third driven beam, the microelectromechanical actuator further comprising:

a second actuator on the substrate that includes a second driver beam that moves parallel to the substrate upon actuation of the second actuator;

a first driven arched beam that is coupled to the first driver beam, the first driven arched beam including end portions that move relative to one another to change the arching of the first driven arched beam in response to the movement of the first driver beam parallel to the substrate; and a second driven arched beam that is coupled to the second driver beam, the second driven arched beam including end portions that move relative to one another to change the arching of the second driven arched beam in response to the movement of the second driver beam parallel to the substrate; and wherein the third driven beam is coupled to the first and second driven arched beams, the third driven beam including end portions that move relative to one another to arch the third driven beam in the direction that is nonparallel to the substrate in response to the changed arching of the first and second driven beams.

38. A microelectromechanical actuator according to claim 37 further comprising:

a fourth driven beam that is coupled to the first and second driven arched beams, the fourth driven beam including end portions that move relative to one another to arch the fourth driven beam in response to the changed arching of the first and second driven arched beams.

39. A microelectromechanical actuator comprising:

a substrate;

first spaced apart supports on the substrate;

a first thermal arched beam that extends between the first spaced apart supports and that further arches upon heating thereof for movement along the substrate in a first direction;

second spaced apart supports on the substrate;

a second thermal arched beam that extends between the second spaced apart supports and that further arches upon heating thereof for movement along the substrate in the first direction; and a driven arched beam including respective first and second end portions that are coupled to the respective first and second thermal arched beams such that the further arching of the first thermal arched beam squeezes the end portions together, the further arching of the second thermal arched beam pulls the end portions apart and simultaneous further arching of the first and second thermal arched beams translates the driven arched beam in the first direction without moving the end portions relative to one another.

40. A microelectromechanical actuator according to claim 39 wherein the first thermal arched beam includes an intermediate portion between end portions thereof, wherein the second thermal arched beam includes an intermediate portion between end portions thereof and wherein the intermediate portion of the respective first and second thermal arched beams are coupled to the respective first and second end portions of the driven arched beam.

41. A microelectromechanical actuator according to claim 39 in combination with at least one of a relay contact, an optical attenuator, a variable circuit element, a valve and a circuit breaker that is mechanically coupled to the driven arched beam for actuation thereby.

42. A microelectromechanical actuator comprising:

a substrate;

a first actuator on the substrate that includes a first driver beam that moves along the substrate in a first direction upon actuation of the first actuator;

a second actuator on the substrate that includes a second driver beam that moves along the substrate in the first direction upon actuation of the second actuator; and a driven arched beam including respective first and second end portions that are coupled to the respective first and second driver beams such that the movement of the first driver beam squeezes the end portions together, the movement of the second driver beam pulls the end portions apart and simultaneous movement of the first and second driver beams translates the driven arched beam in the first direction without moving the end portions relative to one another.

43. A microelectromechanical actuator according to claim 42 in combination with at least one of a relay contact, an optical attenuator, a variable circuit element, a valve and a circuit breaker that is mechanically coupled to the driven arched beam for actuation thereby.

44. A microelectromechanical actuator comprising:

a substrate;

spaced apart supports on the substrate;

a thermal arched beam that extends between the spaced apart supports and that further arches upon heating thereof for movement along the substrate;

a driven arched beam that is coupled to the thermal arched beam, the driven arched beam including end portions that move relative to one another to change the arching of the driven arched beam in response to the further arching of the thermal arched beam, for movement of the driven arched beam along the substrate; and an optical attenuator that is coupled to the driven arched beam and that is arranged to move into an optical path on the substrate in response to movement of the driven arched beam along the substrate such that the optical attenuator blocks at least a portion of optical radiation in the optical path.

45. A microelectromechanical actuator according to claim 44 wherein the optical path is oriented along the substrate.

46. A microelectromechanical actuator according to claim 45 wherein the optical path comprises two optical fibers on the substrate that are oriented in end-to-end relationship, such that the optical attenuator is arranged to move between adjacent ends of the two optical fibers in response to movement of the driven arched beams along the substrate.

47. A microelectromechanical actuator according to claim 44 wherein the optical path is oriented orthogonal to the substrate.

48. A microelectromechanical actuator according to claim 47 wherein the optical path comprises an optical fiber that passes through the substrate such that an end of the optical fiber is parallel to the substrate, wherein the optical attenuator is arranged to cover at least part of the end of the optical fiber in response to movement of the driven arched beam along the substrate.

49. A microelectromechanical actuator according to claim 44 wherein the end portions are squeezed together by the further arching of the thermal arched beam to thereby increase arching of the driven arched beam.

50. A microelectromechanical actuator according to claim 44 wherein the end portions are pulled apart by the further arching of the thermal arched beam to thereby decrease arching of the driven arched beam.

51. A microelectromechanical actuator according to claim 44 wherein the thermal arched beam includes an intermediate portion between end portions thereof and wherein the intermediate portion of the thermal arched beam is coupled to one of the end portions of the driven arched beam.

52. A microelectromechanical actuator according to claim 51 further comprising an anchor that anchors the other end portion of the driven arched beam to the substrate.

53. A microelectromechanical actuator according to claim 44 wherein the spaced apart supports are first spaced apart supports and wherein the thermal arched beam is a first thermal arched beam, the thermal arched beam microelectromechanical actuator further comprising:

second spaced apart supports on the substrate;

a second thermal arched beam that extends between the second spaced apart supports and that further arches upon heating thereof for movement along the substrate; and wherein the driven arched beam is coupled to the first and second thermal arched beams, such that the end portions thereof move relative to one another to change the arching of the driven arched beam in response to the further arching of the first and second thermal arched beams.

54. A microelectromechanical actuator according to claim 44 wherein the spaced apart supports are first spaced apart supports and wherein the thermal arched beam is a first thermal arched beam, the microelectromechanical actuator further comprising:

second spaced apart supports on the substrate;

a second thermal arched beam that extends between the spaced apart supports and that further arches upon heating thereof for movement along the substrate;

a second driven arched beam that is coupled to the second thermal arched beam, the second driven arched beam including end portions that move relative to one another to change the arching of the second driven arched beam in response to the further arching of the thermal arched beam for movement of the second driven arched beam along the substrate; and a third driven arched beam that is coupled to the first and second driven arched beams, the third driven arched beam including end portions that move relative to one another to change the arching of the third driven arched beam in response to the changed arching of the first and second driven arched beams;

wherein the optical attenuator is coupled to the third driven arched beam and is arranged to move into the optical path on the substrate in response to movement of the third driven arched beam along the substrate.

55. A microelectromechanical actuator comprising:

a substrate;

an actuator on the substrate that includes a driver beam that moves along the substrate upon actuation of the actuator;

a driven beam that is coupled to the driver beam, the driven beam including end portions that move relative to one another to arch and move the driven beam along the substrate in response to movement of the driven beam; and an optical attenuator that is coupled to the driven beam and that is arranged to move into an optical path on the substrate in response to movement of the driven beam along the substrate such that the optical attenuator blocks at least a portion of optical radiation in the optical path.

56. A microelectromechanical actuator according to claim 55 wherein the optical path is oriented along the substrate.

57. A microelectromechanical actuator according to claim 56 wherein the optical path comprises two optical fibers on the substrate that are oriented in end-to-end relationship, such that the optical attenuator is arranged to move between adjacent ends of the two optical fibers in response to movement of the driven beam along the substrate.

58. A microelectromechanical actuator according to claim 55 wherein the optical path is oriented orthogonal to the substrate.

59. A microelectromechanical actuator according to claim 55 wherein the optical path comprises an optical fiber that passes through the substrate, wherein the optical attenuator is arranged to cover at least part of the end of the optical fiber in response to movement of the driven beam along the substrate.

60. A microelectromechanical actuator according to claim 55 wherein the end portions are squeezed together by the further arching of the thermal arched beam to thereby increase arching of the driven beam.

61. A microelectromechanical actuator according to claim 55 wherein the end portion s are pulled a part by the further arching of the thermal arched beam to thereby decrease arching of the driven beam.

62. A microelectromechanical actuator according to claim 55 wherein the driver beam is coupled to one of the end portions of the driven beam.

63. A microelectromechanical actuator according to claim 62 further comprising an anchor that anchors the other end portion of the driven beam to the substrate.

64. A microelectromechanical actuator according to claim 55 wherein the actuator is a first actuator, wherein the driver beam is a first driver beam, the microelectromechanical actuator further comprising:

a second actuator on the substrate that includes a second driver beam that moves along the substrate upon actuation of the second actuator; and wherein the driven beam is coupled to the first and second driver beams, such that the end portions thereof move relative to one another to arch the driven beam in response to the movement of the first and second driver beams.

65. A microelectromechanical actuator according to claim 55 wherein the actuator is a first actuator, wherein the driver beam is a first driver beam, the microelectromechanical actuator further comprising:

a second actuator on the substrate that includes a second driver beam that moves along the substrate upon actuation of the second actuator;

a second driven beam that is coupled to the second driver beam, the second driven beam moving along the substrate upon actuation of the second actuator; and a third driven beam that is coupled to the first and second driven beams, the third driven beam including end portions that move relative to one another to change the arching of the third driven beam in response to the movement of the first and second driven beams;

wherein the optical attenuator is coupled to the third driven beam and is arranged to move into an optical path on the substrate in response to movement of the third driven arched beam along the substrate.

* * * * *